US005632060A

United States Patent [19]

Steinberg et al.

[11] Patent Number: 5,632,060

[45] Date of Patent: May 27, 1997

[54] VACUUM CLEANER WITH AGITATION MEMBER DRIVE BELT ACCESS PANEL

[75] Inventors: Gary L. Steinberg, Jenison, Mich.; David I. Oreck, New Orleans, La.

[73] Assignee: Bissell Inc., Grand Rapids, Mich.

[21] Appl. No.: 511,377

[22] Filed: Aug. 4, 1995

[51] Int. Cl.[6] ..... A47L 5/30

[52] U.S. Cl. ..... 15/391; 15/339

[58] Field of Search ..... 15/389, 391, 339

[56] References Cited

U.S. PATENT DOCUMENTS

| | | | |
|---|---|---|---|
| 1,449,003 | 3/1923 | Hoover | 15/389 X |
| 1,485,188 | 2/1924 | Hoff | 15/389 |
| 1,829,582 | 10/1931 | Carson | 15/389 X |
| 1,856,136 | 5/1932 | Orr . | |
| 2,079,293 | 5/1937 | Kirby | 15/389 X |
| 2,149,138 | 2/1939 | Gasner . | |
| 2,253,997 | 8/1941 | Becker . | |
| 2,627,623 | 2/1953 | Humphrey . | |
| 2,780,819 | 2/1957 | Gall . | |
| 3,482,276 | 12/1969 | Fillery | 15/391 X |
| 3,916,476 | 11/1975 | Johnson et al. | 15/391 X |
| 4,167,801 | 9/1979 | Erbor et al. . | |
| 4,490,882 | 1/1985 | Wells | 15/391 X |
| 4,685,171 | 8/1987 | Beaudoin . | |
| 4,912,805 | 4/1990 | Krasznai et al. . | |
| 4,980,945 | 1/1991 | Bewley . | |
| 4,993,108 | 2/1991 | Genge et al. . | |
| 5,129,128 | 7/1992 | Bowerman et al. . | |
| 5,218,736 | 6/1993 | Bartasevich et al. . | |
| 5,297,312 | 3/1994 | Zuiderveen et al. . | |

FOREIGN PATENT DOCUMENTS

| | | |
|---|---|---|
| 1262201 | 10/1989 | Canada . |

*Primary Examiner*—Chris K. Moore

*Attorney, Agent, or Firm*—Varnum, Riddering, Schmidt & Howlett LLP

[57] ABSTRACT

A vacuum cleaner having access panel selectively mounted thereto is shown. The access panel encloses a belt utilized to interconnect the agitation member and the drive shaft for the motor to rotate the agitation member. The access panel has a mounting flange provided on a portion of the edge of the panel which is slidably received in slots formed in the housing. The reception of the mounting flange in the slots in cooperation with a single mounting screw serves to secure the access panel to the housing. The belt can easily be accessed by removing the mounting screw and sliding the access panel laterally relative to the slots to remove the mounting flange from the slots.

27 Claims, 2 Drawing Sheets

VACUUM CLEANER WITH AGITATION MEMBER DRIVE BELT ACCESS PANEL

BACKGROUND OF THE INVENTION

1. Field of the Invention

This invention relates to vacuum cleaners and, more particularly, to an access panel removably mounted to the vacuum cleaner housing for servicing a drive belt interconnecting an agitation member and the drive shaft of a drive motor.

2. Description of the Related Art

Conventional upright, canister and hand held vacuum cleaners incorporate an agitation member or rotary brush to agitate the carpet during application of the vacuum suction. It is well known that incorporation of an agitation member enhances the cleaning performance of the vacuum cleaner. Typically, the motive means for the agitation member comprises an electric motor mounted so that the drive shaft extends substantially parallel to the longitudinal axis of the agitation member and a belt interconnecting the drive shaft and the agitation member.

As can be expected, the belt must be periodically serviced. A variety of access panels and pivoting plate members mounted to the housing are known for enclosing an access aperture provided for servicing the belt. Examples of these different structures are seen in U.S. Pat. No. 5,129,128 to Bawerman et al.; U.S. Pat. No. 4,685,171 to Beaudoin; U.S. Pat. No. 2,149,138 to Gasher; and U.S. Pat. No. 5,297,312 to Zuiderveen et al.

One problem with the known vacuum assemblies is providing an aperture large enough such that the user can easily access the fall length of the belt extending between the drive shaft and the agitation member. A second problem with the known vacuum cleaner is providing an access panel enclosing the service aperture wherein the panel is quickly and easily removed from the vacuum housing.

SUMMARY OF THE INVENTION

The vacuum cleaner according to the invention overcomes the problems of the prior art by providing an access aperture sufficiently large enough so that the user can easily access both the motor drive shaft and the agitation member ends of the belt while also providing simple means for securely mounting the access panel to the vacuum housing.

A vacuum cleaner according to the invention includes a housing having an agitation member or rotary brush mounted therein. A drive motor having a drive shaft is mounted adjacent the agitation member and a belt is used to interconnect the agitation member and drive motor. A belt service aperture is formed in the housing for servicing the belt and an access panel is adapted to be mounted to the housing to substantially enclose the aperture when the vacuum is in use. The access panel is adapted to be removed from the housing when servicing of the belt is necessary. The access panel according to the invention has a flange or slot provided on the top or bottom edge of the panel. Preferably, the panel has a flange which extends along the top and bottom and one of the side edges of the panel. At least one flange or slot is provided on the housing adjacent the servicing aperture. Preferably the housing incorporates a slot which slidably receives the flange. The slot and flange are oriented so that the flange is slidably received in the slot by sliding the panel in a direction substantially parallel to the top and bottom edges of the panel.

In another aspect of the invention, the belt service aperture of the vacuum housing is dimensioned to encompass both the drive shaft and the belt receiving portion of the agitation member, thereby providing the user with easy servicing access to both the drive shaft and the belt receiving portion of the agitator.

Preferably, the aperture is formed in the side wall of the vacuum housing and wraps around to encompass both a portion of the front wall and the top wall. With this structure, the user can easily replace a worn or damaged belt.

BRIEF DESCRIPTION OF THE DRAWINGS

The invention will now be described with reference to the drawings in which.

DETAILED DESCRIPTION OF THE PREFERRED EMBODIMENTS

Figure 1:
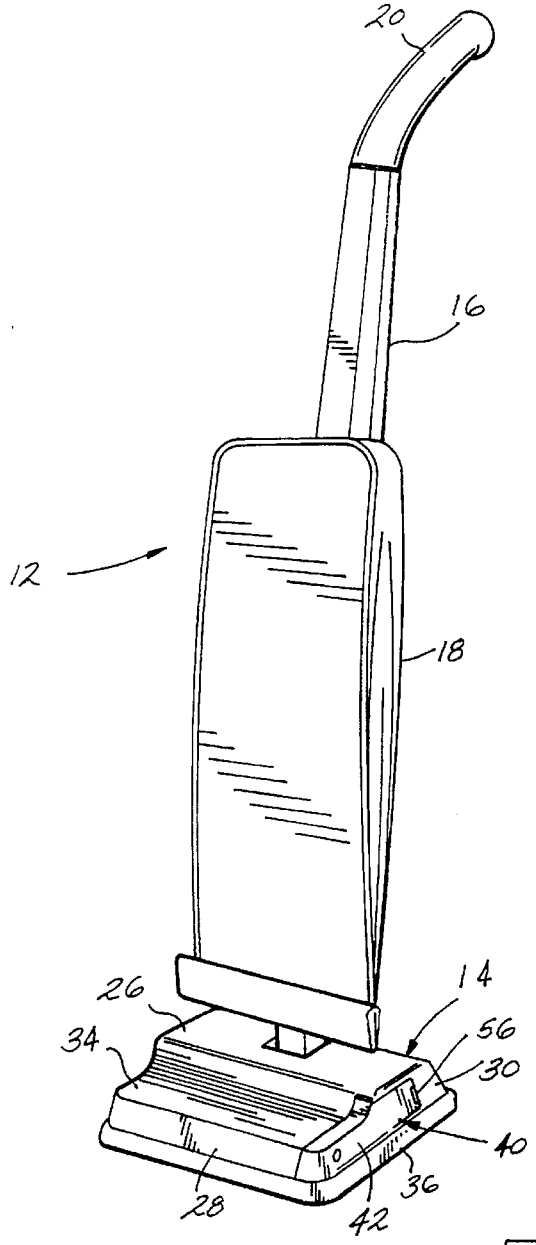
FIG. 1 is a perspective view of one embodiment of a vacuum cleaner incorporating the access panel according to the invention and showing the access panel in the operative position.

Referring now to the drawings and to FIG. 1 is particular, a vacuum cleaner 12 incorporating an access panel 40 according to the invention is shown. In this embodiment, the vacuum cleaner 12 comprises a lower housing 14, an elongated handle 16 pivotally mounted at its base to the lower housing 14, a vacuum bag housing 18 provided on the elongated handle 16 and a grip member 20 provided on the upper, terminal end of the elongated handle 16.

The lower housing 14 comprises a top wall 26, a front wall 28, a rear wall (not shown) and a pair of opposed side walls 30. In this embodiment, the lower housing also comprises an intermediate contoured wall 34 extending between the front wall 28 and the top wall 26. An elastomeric bumper 36 extends around the base of the front 28, side 30, 32 and rear walls of the housing.

Figure 2:
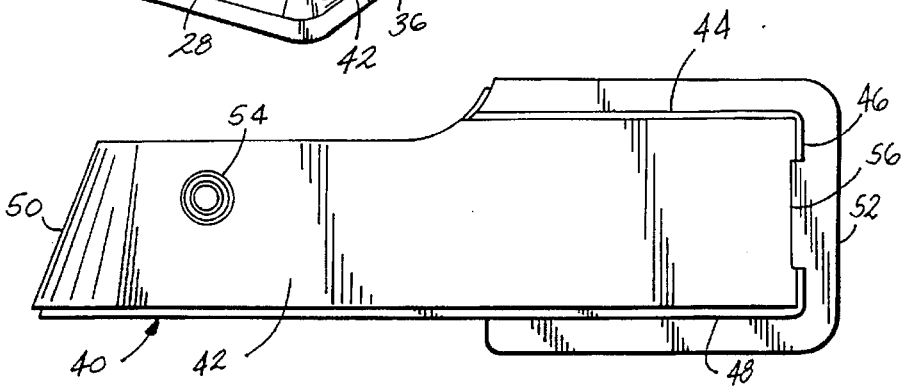
FIG. 2 is a partial, exploded view of the vacuum housing showing the access panel according to the invention in the service position.
Figure 3:
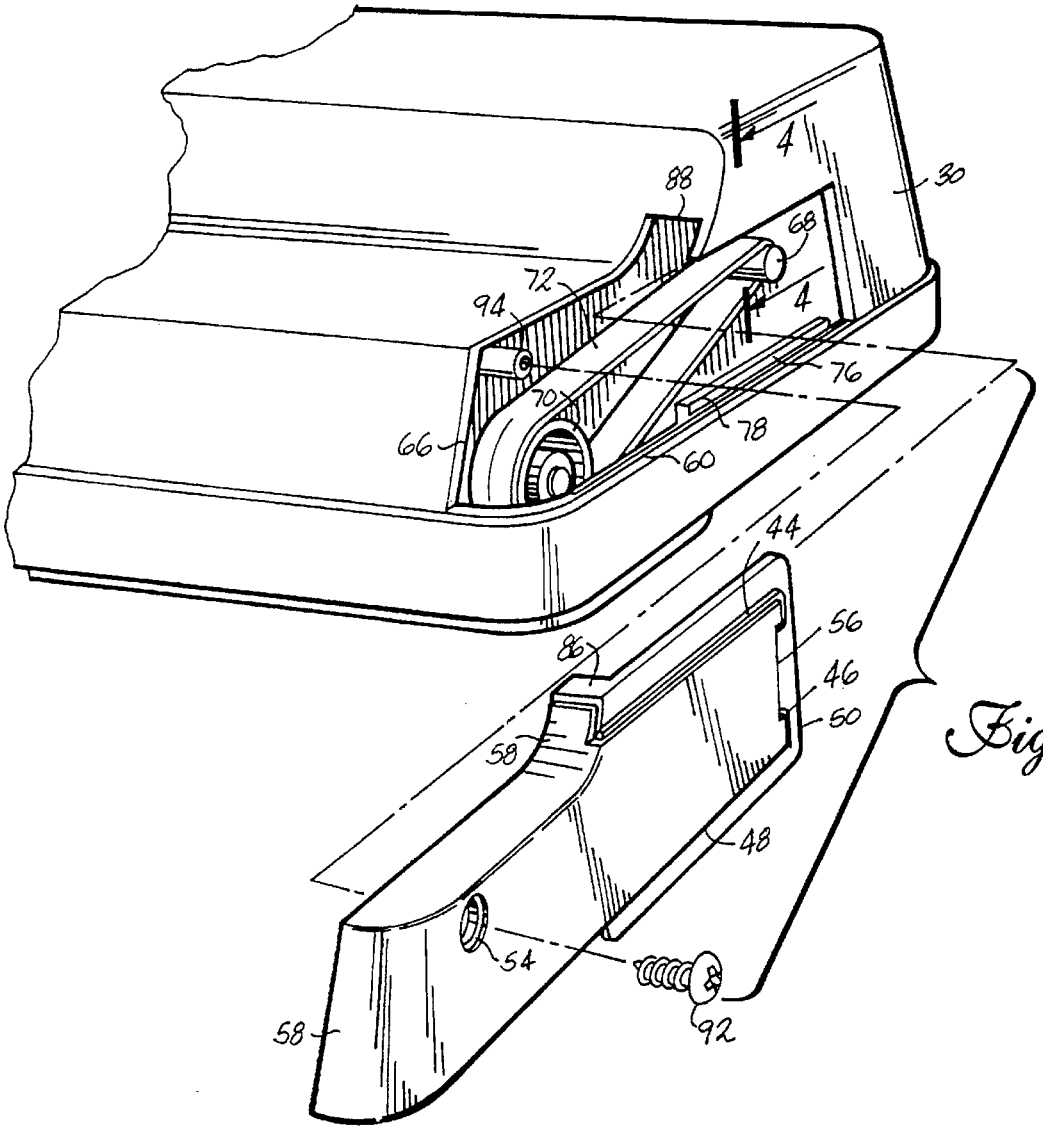
FIG. 3 is a side elevational view of the access panel according to the invention.

A belt access panel 40 is selectively mounted to the lower housing 14 so that the user can easily access a portion of the interior of the lower housing 14. As seen in FIGS. 1–3, the access panel 40 comprises an exterior wall 42, a top edge 44, a rear edge 46, a bottom edge 48, and a front edge 50. Preferably, a mounting flange 52 is provided on the panel 40 and extends along the rear edge 46 and a portion of the top and bottom edges 44, 48. A recessed mounting screw aperture 54 is formed in the exterior wall 42 a spaced distance from the mounting flange 52. In addition, a depression 56 is formed in the rear edge 46 immediately adjacent the mounting flange 52.

Preferably, the access panel 40 is contoured such that the front edge 50 of the access panel 40 wraps around the lower housing side wall 30 to the front wall 28. In addition, an extension 58 of the exterior wall 42 of the access panel 40 wraps around a portion of the top edge 44 to form a portion of the intermediate wall 34. As seen in FIG. 2, the mounting flange 50 similarly extends along this extension 58.

As seen in FIGS. 1 and 2, the access panel 40 is selectively mounted to the lower housing 14. The lower housing has a service aperture 66 formed immediately adjacent the motor drive shaft 68 and the belt receiving portion of the agitator member 70. The belt 72 is received on the drive shaft 68 and the belt receiving portion of the agitator member 70 to convey the motive force from the drive shaft 68 to the agitator member 70. Preferably, the service aperture 66 extends the full length of the belt 72 to encompass and provide easy access to both the drive shaft 68 and the belt receiving portion of the agitator member 70 so that the user can easily access both ends of the belt. With this extended length for the aperture, the user can easily remove and replace the belt 72 and visually inspect both the drive shaft and the belt receiving portion 70.

Figure 4:
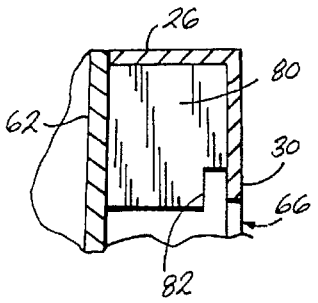
FIG. 4 is a partial sectional view of the vacuum housing taken along lines 4—4 of FIG. 3.

Previously, changing or servicing an agitator belt was a frustrating and difficult process. Therefore, any simplification to the process of servicing the belt will undoubtedly have a positive effect with consumers and users of the product. The structure of the belt access panel 40 and the service aperture 66 according to the invention provides such benefits. First, as noted above, the service aperture 66 extends substantially the entire length of the belt so that the user can easily access the entire length of the belt. Secondly, the belt access panel 40 is quickly and easily removed and replaced on the lower housing 14. This simple removal process is achieved, in part, by slidably mounting the panel 40 to the housing 14. As seen in FIG. 2, the lower housing 14 includes a slot 76 formed adjacent the bottom edge 60 of the service aperture. The slot 76 is adapted to slidably receive the mounting flange 52 of the access panel 40. The slot 76 is defined by the side wall 30 of the lower housing and a flange 78 spaced a short distance laterally from the side wall 30. As seen in FIG. 4, at least one rib 80 is provided on the lower housing 14. The rib 80 extends between the internal wall 62, side wall 30 and top wall 26 of the lower housing 14. A channel 82 is provided in the rib 80 and the channel is adapted to slidably receive the flange 52 extending along the top edge 44 of the access panel 40. Preferably, at least two ribs 80 having panel receiving channels or slots are provided on the lower housing 14.

The slot 76 and rib channel 82 are adapted to slidably receive the mounting flange 52 extending from the bottom 48 and top edges 44, respectively, of the access panel 40. The portion of the flange 52 extending along the rear edge 44 of the access panel 40 extends into the housing 14 and abuts the interior surface of the side wall 30. Preferably, the access panel 40 also includes an intermediate wall extension 58 so that the flange 52 extends laterally inwardly with the intermediate wall extension 58. The lateral portion 86 of the mounting flange 52 contacts an upper edge 88 of the service aperture 66 when the panel is in the operative position.

A benefit of the structure of the access panel 40 according to the invention is the fact that only a single mounting screw 92 is necessary to secure the access panel 40 to the housing 14. After the access panel 40 has been slidably mounted to the housing so that the mounting flange 52 is received in the slot 76 and channel 82, the mounting screw 92 is inserted into the screw aperture 54 and threadably mounted to a boss 94 formed on the housing 14. The screw 92 secures the front edge 50 of the access panel 40 to the housing. The cooperation of the mounting flange 52, slot 76 and channel 82 in conjunction with the single screw 92 creates a secure yet easily removed panel.

In operation, the access panel 40 can be quickly and easily removed from the housing 14 by first removing the screw 92. Next, the access panel 40 is slid forward relative to the lower housing 14. A screwdriver, coin or other thin object is inserted into the depression 56 formed at the rear of the housing and then pressure is applied to slide the panel 40 forward, in a direction substantially parallel to the top 44 and bottom 48 edges of the panel. After sliding the panel 40 a sufficient distance, the flange 52 will be entirely removed from the slot 76 and channel 82 so that the panel 40 can be lifted away from the housing 14.

The panel is installed on the housing by first aligning the flange 52 with the slot 76 and channel 82 and then sliding the panel 40 rearwardly with respect with the lower housing 14, in a direction substantially parallel to the top 44 and bottom 48 edges of the panel 40. When the panel is fully received in the slot 76 and channel 82, then the screw 92 can be reinserted into the aperture 54 and screwed into the boss 94.

Although the preferred embodiment shows the flange 52 formed on the panel and the slot 76 on the housing, this structure can be reversed. In fact, any structure which accommodates the sliding movement of the panel with respect to the housing can be incorporated onto one of the panel and housing within the scope of the invention.

Although the access panel 40 is depicted for use with an upright vacuum cleaner, the access panel can be incorporated on any vacuum cleaner utilizing a belt to interconnect the motor drive shaft and an agitator. Examples of other vacuum cleaners which can incorporate the invention include a canister vacuum cleaner and a hand held vacuum cleaner. All of these vacuum cleaners can benefit by having an elongated service aperture formed therein and an access panel which is quickly and easily removed from the housing for servicing the belt.

Reasonable variation and modification are possible within the spirit of the foregoing specification and drawings without departing from the scope of the invention.

The embodiments for which an exclusive property or privilege is claimed are defined as follows:

1. In an improved vacuum cleaner comprising a housing having an agitation member with a belt receiving portion and rotatably supported in the housing, a drive motor with a drive shaft, a belt interconnecting the belt receiving portion of the agitation member and the drive shaft, an aperture formed in the housing for servicing the belt, an access panel adapted to be mounted to the housing and to substantially enclose the aperture in an operative position and to be removed from the housing in a service position, the access panel having top, bottom, and opposed side edges and a fastener adapted to secure the access panel to the housing in the operative position, the improvement comprising:

at least one of a flange and slot provided on at least one of the top and bottom edges of the access panel; and at least one of the other of said flange and slot provided on the housing adjacent the aperture, said at least one flange and said at least one slot being oriented so that the at least one flange is slidably received in the at least one slot by sliding the panel in a direction substantially parallel to said one of the top and bottom edges.

2. An improved vacuum cleaner according to claim 1 wherein the vacuum cleaner comprises an upright vacuum cleaner and the housing comprises a floor engaging housing.

3. An improved vacuum cleaner according to claim 1 wherein flanges are provided on both the top and bottom edges of the panel and slots are provided on the housing adjacent the aperture, the slots and flanges being oriented so that the flanges are slidably received in the slots by sliding the panel in a direction substantially parallel to the top and bottom edges.

4. An improved vacuum cleaner according to claim 3 and further comprising a rib provided in the housing, wherein the rib is substantially transverse to the at least one flange and the slot is formed in the rib.

5. An improved vacuum cleaner according to claim 1 and further comprising a depression provided in the panel, the depression being adapted to provide means for gripping the panel and sliding it from the operative position to the service position.

6. An improved vacuum cleaner according to claim 1 wherein the aperture is dimensioned to encompass both the drive shaft and the belt receiving portion of the agitation member thereby providing the user with easy access to both the drive shaft and belt receiving portion for servicing the belt.

7. An improved vacuum cleaner according to claim 1 wherein the housing has a top, rear, front and opposed side walls and the aperture is formed in one of the side walls.

8. An improved vacuum cleaner according to claim 7 wherein the aperture also encompasses at least a portion of the front wall of the housing.

9. An improved vacuum cleaner according to claim 7 wherein the aperture also encompasses at least a portion of the top wall of the housing.

10. An improved vacuum cleaner according to claim 9 wherein the aperture also encompasses at least a portion of the front wall of the housing.

11. A vacuum cleaner comprising:

a housing;

an agitation member rotatably supported in the housing and having a belt receiving portion;

a drive motor provided in the housing and having a drive shaft;

a belt interconnecting the belt receiving portion of the agitation member and the drive shaft an aperture formed in the housing, the aperture encompassing both the drive motor drive shaft and the belt receiving portion of the agitation member so that the belt can be accessed for servicing;

an access panel which is slidably mounted to the housing and adapted to substantially enclose the aperture in an operative position and to be slidably removed from the housing in a service position.

12. A vacuum cleaner according to claim 11 and further comprising a fastener for securing the panel to the housing in the operative position.

13. A vacuum cleaner according to claim 12 and further comprising a depression provided in the panel, the depression being adapted to provide means for gripping the panel and sliding it from the operative position to the service position.

14. A vacuum cleaner according to claim 12 wherein the access panel has top, bottom, and opposed side edges and further comprising flanges provided on both the top and bottom edges and slots provided on the housing adjacent the aperture, the slots being adapted to slidably receive the top and bottom edge flanges, the slots and flanges being oriented so that the flanges are slidably received in the slots by sliding the panel in a direction substantially parallel to the top and bottom edges.

15. A vacuum cleaner according to claim 14 and further comprising a rib provided in the housing, the rib being substantially transverse to the flange and one of said slots being formed in the rib.

16. A vacuum cleaner according to claim 11 wherein the housing has top, rear, front and opposed side walls and the aperture is formed in one of the side walls.

17. A vacuum cleaner according to claim 16 wherein the aperture also encompasses at least a portion of the front wall of the housing.

18. A vacuum cleaner according to claim 16 wherein the aperture also encompasses at least a portion of the top wall of the housing.

19. A vacuum cleaner according to claim 18 wherein the aperture also encompasses at least a portion of the front wall of the housing.

20. In an improved vacuum cleaner comprising a housing having an agitation member having a belt receiving portion and being rotatably supported in the housing, a drive motor having a drive shaft, a belt interconnecting the belt receiving portion of the agitation member and the drive shaft, an aperture formed in the housing through which the belt can be accessed for servicing, an access panel adapted to be mounted to the housing and to substantially enclose the aperture in an operative position and to be removed from the housing in a service position, the access panel having top, bottom, and opposed side edges and a fastener adapted to secure the access panel to the housing in the operative position, the improvement comprising:

a flange provided on at least one of the top and bottom edges of the access panel; and a slot provided on the housing adjacent the aperture adapted to slidably receive said flange, the slot and flange being oriented so that the flange of the access panel is slidably received in the slot by sliding the panel in a direction substantially parallel to the top and bottom edges.

21. An improved vacuum cleaner according to claim 21 wherein the aperture is dimensioned to encompass both the drive shaft and the belt receiving portion of the agitation member thereby providing the user with easy access to both the drive shaft and belt receiving portion for servicing the belt.

22. An improved vacuum cleaner according to claim 20 wherein the vacuum cleaner comprises an upright vacuum cleaner and the housing comprises a floor engaging housing.

23. An improved vacuum cleaner according to claim 20 and further comprising a depression provided in the access panel, the depression being adapted to provide means for gripping the access panel and sliding it from the operative position to the service position.

24. An improved vacuum cleaner according to claim 20 wherein the housing has top, rear, front, and opposed sidewalls and the aperture is formed in one of the sidewalls.

25. An improved vacuum cleaner according to claim 24 wherein the aperture also encompasses at least a portion of the front wall of the housing.

26. An improved vacuum cleaner according to claim 24 wherein the aperture also encompasses at least a portion of the top wall of the housing.

27. An improved vacuum cleaner according to claim 26 wherein the aperture also encompasses at least a portion of the front wall of the housing.

* * * * *

UNITED STATES PATENT AND TRADEMARK OFFICE

CERTIFICATE OF CORRECTION

PATENT NO.: 5,632,060

DATED: May 27, 1997

INVENTOR(S): Steinberg et al.

It is certified that error appears in the above-identified patent and that said Letters Patent is hereby corrected as shown below:

On the title page,

Item [73] Assignee: Oreck Corporation, New Orleans, LA

Signed and Sealed this

Eleventh Day of August 1998

Bruce Lehman

*Attest:*

BRUCE LEHMAN

*Attesting Officer*

*Commissioner of Patents and Trademarks*

US005632060C1

(12) EX PARTE REEXAMINATION CERTIFICATE (5550th)

United States Patent
Steinberg et al.

(10) Number: US 5,632,060 C1
(45) Certificate Issued: Oct. 10, 2006

(54) VACUUM CLEANER WITH AGITATION MEMBER DRIVE BELT ACCESS PANEL

(75) Inventors: Gary L. Steinberg, Jenison, MI (US); David I. Oreck, New Orleans, LA (US)

(73) Assignee: Oreck Corporation, New Orleans, LA (US)

Reexamination Request:
No. 90/006,668, Jun. 16, 2003

Reexamination Certificate for:

| | |
|---|---|
| Patent No.: | **5,632,060** |
| Issued: | **May 27, 1997** |
| Appl. No.: | **08/511,377** |
| Filed: | **Aug. 4, 1995** |

Certificate of Correction issued Aug. 11, 1998.

(51) Int. Cl.
*A47L 5/30* (2006.01)

(52) U.S. Cl. ..... 15/391; 15/339
(58) Field of Classification Search ..... 15/391, 15/339
See application file for complete search history.

(56) References Cited

U.S. PATENT DOCUMENTS 3,916,476 A * 11/1975 Johnson et al. ..... 15/391
4,942,641 A 7/1990 Gerke, Jr. et al.

* cited by examiner

*Primary Examiner*—Theresa T. Snider

(57) ABSTRACT

A vacuum cleaner having access panel selectively mounted thereto is shown. The access panel encloses a belt utilized to interconnect the agitation member and the drive shaft for the motor to rotate the agitation member. The access panel has a mounting flange provided on a portion of the edge of the panel which is slidably received in slots formed in the housing. The reception of the mounting flange in the slots in cooperation with a single mounting screw serves to secure the access panel to the housing. The belt can easily be accessed by removing the mounting screw and sliding the access panel laterally relative to the slots to remove the mounting flange from the slots.

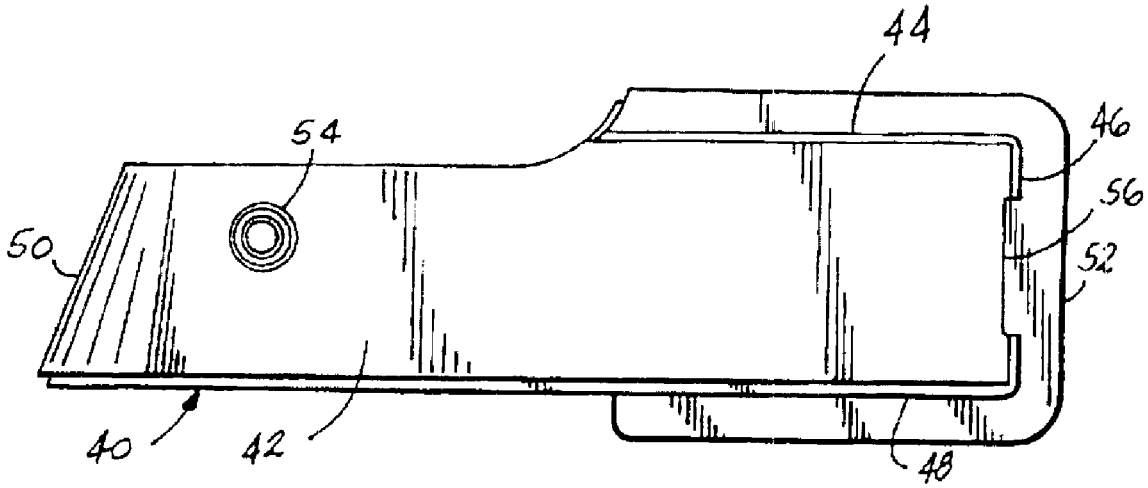

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 32–38:

One problem with the known vacuum assemblies is providing an aperture large enough such that the user can easily access the [fall] *full* length of the belt extending between the drive shaft and the agitation member. A second problem with the known vacuum cleaner is providing an access panel enclosing the service aperture wherein the panel is quickly and easily removed from the vacuum housing.

Column 2, lines 31–38:

Referring now to the drawings and to FIG. 1 [is] *in* particular, a vacuum cleaner 12 incorporating an access panel 40 according to the invention is shown. In this embodiment, the vacuum cleaner 12 comprises a lower housing 14, an elongated handle 16 pivotally mounted at its base to the lower housing 14, a vacuum bag housing 18 provided on the elongated handle 16 and a grip member 20 provided on the upper, terminal end of the elongated handle 16.

Column 2, lines 58–64:

Preferably, the access panel 40 is contoured such that the front edge 50 of the access panel 40 wraps around the lower housing side wall 30 to the front wall 28. In addition, an extension 58 of the exterior wall 42 of the access panel 40 wraps around a portion of the top edge 44 to form a portion of the intermediate wall 34. As seen in FIG. 2, the mounting flange [50] *52* similarly extends along this extension 58.

Column 3, lines 13–38:

Previously, changing or servicing an agitator belt was a frustrating and difficult process. Therefore, any simplification to the process of servicing the belt will undoubtedly have a positive effect with consumers and users of the product. The structure of the belt access panel 40 and the service aperture 66 according to the invention provides such benefits. First, as noted above, the service aperture 66 extends substantially the entire length of the belt so that the user can easily access the entire length of the belt. Secondly, the belt access panel 40 is quickly and easily removed and replaced on the lower housing 14. This simple removal process is achieved, in part, by slidably mounting the panel 40 to the housing 14. As seen in FIG. [2] *3*, the lower housing 14 includes a slot 76 formed adjacent the bottom edge 60 of the service aperture. The slot 76 is adapted to slidably receive the mounting flange 52 of the access panel 40. The slot 76 is defined by the side wall 30 of the lower housing and a flange 78 spaced a short distance laterally from the side wall 30. As seen in FIG. 4, at least one rib 80 is provided on the lower housing 14. The rib 80 extends between the internal wall 62, side wall 30 and top wall 26 of the lower housing 14. A channel 82 is provided in the rib 80 and the channel is adapted to slidably receive the flange 52 extending along the top edge 44 of the access panel 40. Preferably, at least two ribs 80 having panel receiving channels or slots are provided on the lower housing 14.

AS A RESULT OF REEXAMINATION, IT HAS BEEN DETERMINED THAT:

The patentability of claims 1–10, 13–15, 18–20 and 22–27 is confirmed.

Claims 11–12 and 16–17 are cancelled.

Claim 21 is determined to be patentable as amended.

21. An improved vacuum cleaner according to claim [21] *20* wherein the aperture is dimensioned to encompass both the drive shaft and the belt receiving portion of the agitation member thereby providing the user with easy access to both the drive shaft and belt receiving portion for servicing the belt.

* * * * *